United States Patent [19]

Barnes

[11] 4,330,877

[45] May 18, 1982

[54] ELECTRICALLY ILLUMINATED WRIST WATCH DIAL

[76] Inventor: Robert W. Barnes, 108 Deep Dale Dr. East, Levittown, Pa. 19056

[21] Appl. No.: 191,149

[22] Filed: Sep. 26, 1980

Related U.S. Application Data

[63] Continuation of Ser. No. 24,694, Mar. 28, 1979, abandoned, which is a continuation-in-part of Ser. No. 518,341, Oct. 29, 1974, abandoned.

[51] Int. Cl.[3] ..... G04B 19/30

[52] U.S. Cl. ..... 368/67; 368/227; 368/204; 362/29; 362/288; 362/306

[58] Field of Search ..... 368/67, 68, 69, 227, 368/203, 204, 205, 228, 239; 362/23, 29, 30, 288, 306, 285, 278

[56] References Cited

U.S. PATENT DOCUMENTS

| | | | |
|---|---|---|---|
| 657,331 | 9/1900 | Christensen | 362/29 |
| 2,534,877 | 12/1950 | Owen | 368/227 |
| 2,916,871 | 12/1959 | Wegner | 368/67 |
| 2,938,327 | 5/1960 | Vogel | 368/67 |
| 2,974,474 | 3/1961 | Wegner | 368/204 |
| 3,018,614 | 6/1962 | Brien | 368/227 |
| 3,224,184 | 12/1965 | Brien | 368/227 |
| 3,609,960 | 10/1971 | Huther | 368/67 |
| 3,747,322 | 7/1973 | Eckenrode | 368/67 |
| 3,754,130 | 8/1973 | Stone et al. | 368/227 |
| 3,788,061 | 1/1974 | Tornquist et al. | 368/67 |
| 3,855,784 | 12/1974 | Foellner | 368/67 |
| 3,864,905 | 2/1975 | Richardson | 368/67 |
| 3,913,312 | 10/1975 | Numabe | 368/67 |

*Primary Examiner*—B. A. Reynolds
*Assistant Examiner*—Philip H. Leung
*Attorney, Agent, or Firm*—Florence U. Reynolds

[57] ABSTRACT

The dial face of a battery-operated electric wrist watch is illuminated momentarily by manual pressure on a switch connecting a miniature light bulb, mounted between the crystal (lens) and the dial face, to the battery of the watch.

5 Claims, 3 Drawing Figures

ELECTRICALLY ILLUMINATED WRIST WATCH DIAL

This is a continuation of application Ser. No. 24,694, filed Mar. 28, 1979, now abandoned, which is a continuation-in-part of application Ser. No. 518,341, filed Oct. 29, 1974, now abandoned.

SUMMARY OF THE INVENTION

The invention relates to electrical and electronic wrist watches, with provisions for self-contained illumination of the dial face for viewing in dark or dimly lighted areas.

Previous attempts to illuminate conventional watch dial faces generally suffer one or more of the disadvantages described in the following: (1) the lack of uniform illumination of the dial face, produced by the off-center positioning of the light source as shown in U.S. Pat. Nos. 2,916,871; 2,974,474; 2,938,327; 3,609,960; and 3,747,322, and (2) in designs which utilize a bulb and connecting wires attached to, or imbedded in, the watch crystal which are prone to failure or erratic performance from electrical contact corrosion, high contact resistance or varying contact pressure at the point where the crystal wire-contact press against circuit contacts on the watch case, as shown in U.S. Pat. Nos. 3,855,784; 3,788,061; and 3,018,614.

The invention comprises the combination of a battery-operated electric or electronic wrist watch having a conventional dial face and crystal arrangement with a bulb positioned over the center of the dial face to uniformly illuminate the dial face and being electrically connected to the internal battery that powers the watch mechanism; suitably contoured bulb support-members that also function as electrical conductors for the bulb circuit; a glare shield mounted between the crystal and the bulb and suitably shaped to cover the bulb from direct view; and a manually operable switch for actuating said bulb momentarily by manual pressure on the switch which is maintained in the open position by mechanical spring tension.

DETAILED DESCRIPTION OF THE INVENTION

Figure 1:
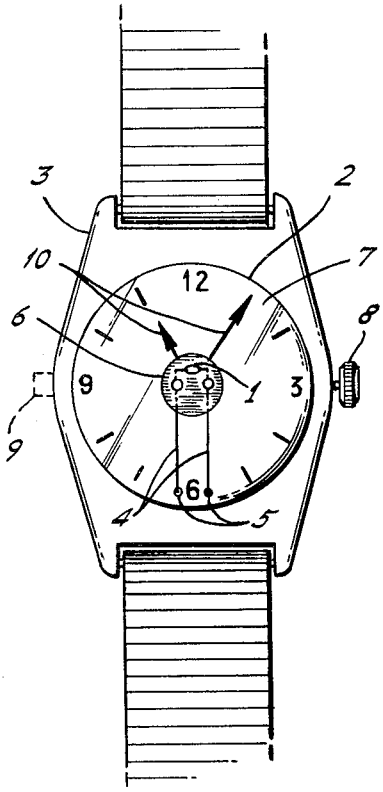
FIG. 1 is a plan view showing the relative position of bulb, bulb support conductors and glare shield on a conventional wrist watch.

FIG. 1 illustrates one embodiment of the invention wherein a miniature light bulb 1 is mounted on the dial face 2 of an electric wrist watch 3 and is mechanically supported in position over the center of the dial face 2 by a pair of bulb support conductors 4 which are electrically insulated from the dial face 2 by the feed-through insulators 5.

Figure 2:
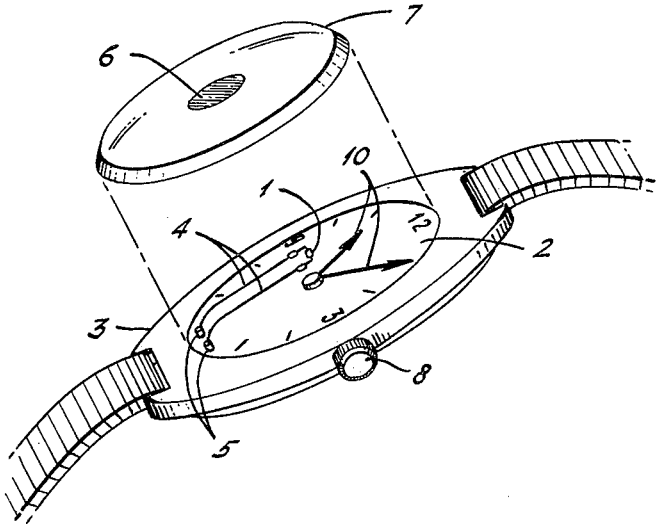
FIG. 2 is an exploded view in perspective showing the mechanical positioning of components in the embodiment of FIG. 1.

FIG. 2 is a further clarification of the embodiment shown in FIG. 1 and shows the contour of bulb support conductors 4 which follow the shape of the under-side of crystal 7, and the position of the feed-through insulators 5 toward the outer edge of the dial face 2, in combination providing an adequate clearance for the passage of the watch hands 10 along with sufficient clearance between the case of the electric wrist watch 3 and the bulb support conductors 4 to seat the crystal 7.

Figure 3:
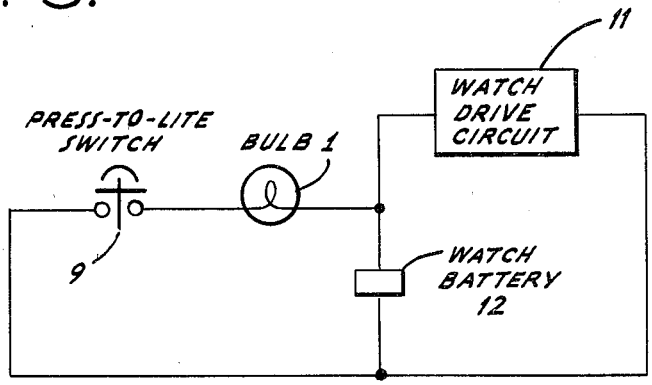
FIG. 3 is the schematic diagram for connection of the bulb to the existing battery circuit of the watch.

FIG. 3 is the schematic diagram showing the bulb 1 and the press-to-lite switch 9 connected to the watch drive circuit 11 and to the watch battery 12.

The bulb support conductors in the preferred embodiment are thin metallic wires, contoured to the shape of the watch crystal, and are typically spring steel or piano wire. These supporting wires and electrically attached bulb are essentially free-standing in that neither is attached to the watch crystal, but do press up against the crystal as a result of upward spring pre-load contouring of the supporting wires prior to assembly of the watch crystal to the watch case. The pre-load pressure would maintain proper positioning of the bulb in all axes, and would minimize vibration and shock bounce of both supporting wires and bulb. The supporting wires are rigidly attached at the ends, furtherest from the bulb, to the feed-through insulators near the outer edge of the dial face, and are electrically connected through the dial face to the battery and press-to-lite switch. The supporting wires are of sufficient size to conduct the electric current to the bulb and maintain an adequate pre-load pressure, but are kept to a minimum size as appropriate for decorative and viewing considerations. The feed-through insulators need not be of the insulating type if a plastic or other electrically non-conductive dial face is used.

The preferred embodiment comprises a suitable glare shield attached to the watch crystal. However, the glare shield need not be attached to the watch crystal, but could be affixed to either or both the bulb and support conductors. The glare shield is opaque, with the side facing the dial face being reflective to direct the bulb lighting downward over the dial face and hands, and is electrically non-conducting at any point of contact with the bulb leads and supporting wires.

Electrical circuit positions of the bulb and press-to-lite switch are interchangeable since they are in series connection. In the use of a non-electric wind-up watch mechanism, the electric circuit for the bulb, battery, and press-to-lite switch remain the same, eliminating only the two leads used to power the electric or electronic watch drive circuit.

I claim:

1. In combination with a battery-operated wrist watch having an internal battery, a casing, a dial face, a crystal and a time-set stem, (a) a miniature electric bulb mechanically supported in position over the center of said dial face against, and without attachment to, the inner surface of said crystal so as to be capable of uniformly illuminating said dial face; (b) a pair of bulb support conductors, electrically connected to said bulb, said support conductors being in the form of spring metal wires with their ends opposite the bulb connections being attached and electrically insulated at the outer edge of the watch dial face and suitably shaped to follow the contour of the inner surface of said crystal so as to avoid interference between said spring wires and the watch hands; said spring wires being shaped and affixed to said dial face such that assembly of said crystal to the watch casing compresses said spring wires in toward said dial face to produce and maintain a positive spring-tension force between said watch crystal and said spring wires so as to maintain said bulb and said spring wires in proper position without attachment to said crystal regardless of the axes of positions to which the watch is normally subjected, so as to minimize vibration and shock bounce of said spring wires and said bulb; (c) a glare shield mounted above said bulb and suitably shaped to cover said bulb; (d) a manually actuated momentary electric switch of the normally open type for actuating said bulb to illuminate said dial face, wherein one of said bulb support conductors connects one side of said bulb to one terminal of said battery and the other bulb support conductor connects the second side of said bulb to one terminal of said switch; and (e) an electric lead connecting the second terminal of said switch to the second terminal of said battery, wherein said bulb, said switch and said battery are connected in series circuit when said switch is closed; said series circuit being in parallel connection to the electric operating circuit of said watch as relates to both circuits operating simultaneously from said battery.

2. The wrist watch combination of claim 1, wherein said glare shield is attached to said crystal.

3. The wrist watch combination of claim 1, wherein said glare shield is attached to said bulb support conductors.

4. The wrist watch combination of claim 1, wherein said glare shield is attached to said bulb.

5. The wrist watch combination of claim 1, wherein said glare shield is attached to said bulb and said bulb support conductor.

* * * * *